US006602103B1

(12) United States Patent
Good

(10) Patent No.: US 6,602,103 B1
(45) Date of Patent: Aug. 5, 2003

(54) FLOAT DEVICE

(76) Inventor: Steven R. Good, 3090 Stanhope Way, Sacramento, CA (US) 95833

( * ) Notice: Subject to any disclaimer, the term of this patent is extended or adjusted under 35 U.S.C. 154(b) by 0 days.

(21) Appl. No.: 09/992,830

(22) Filed: Nov. 15, 2001

(51) Int. Cl.[7] ..... B63B 22/00
(52) U.S. Cl. ..... 441/133
(58) Field of Search ..... 114/61.1, 264, 114/265, 266, 123, 292, 283; 441/133

(56) References Cited

U.S. PATENT DOCUMENTS 2,990,804 A * 7/1961 Garehime ..... 114/283
4,766,830 A * 8/1988 Kunz ..... 114/127
4,898,113 A * 2/1990 Tapley et al. ..... 114/283
5,567,188 A * 10/1996 Allebosch ..... 440/38
5,692,450 A * 12/1997 Alter et al. ..... 114/61.24

OTHER PUBLICATIONS

RRS Industries, Inc., "Tuffloat the Best Barrier Afloat", 2 pages, Sacramento, California.

* cited by examiner

*Primary Examiner*—Stephen Avila
(74) *Attorney, Agent, or Firm*—Theodore J. Bielen, Jr.

(57) ABSTRACT

A float device utilizing a body having an outer surface and a core of floatation material located inwardly from the outer surface. A spine passes through the core of floatation material and includes a first end portion and a second end portion, both of which extend outwardly from the surface of the body. A flange is connected to the spine first and second portions to allow interconnection with float devices of like construction to form a floating boom.

9 Claims, 3 Drawing Sheets

FLOAT DEVICE

BACKGROUND OF THE INVENTION

The present invention relates to a novel and useful floatation device.

Water barriers have often been used to prevent the passage of marine vessels and other floating objects, and flotsam, such as logs, debris, and the like. Such water barriers generally involve a cable, net, or other similar device which spans a body of water between two fixed points.

In the past, booms have been employed which are formed by interlinked floats. Although satisfactory to a certain degree, booms constructed of interlinked floats lack durability in saltwater environments and bodies of water possessing wave motion. For example, in a brochure entitled "Tuffloat the Best Barrier Afloat" a floating element is disclosed in which interconnection between like floating elements is achieved by the use of plates that are connected to a steel channel which itself is bolted to the exterior of the float unit. Unfortunately, such system is susceptible to corrosion and destruction by environmental forces.

A floating device which is durable and may be formed into a boom in fresh or saltwater conditions would be a notable advance in the marine industry field.

BRIEF SUMMARY OF THE INVENTION

In accordance with the present invention a novel and useful float device is herein provided.

The float device of the present invention utilizes a body having an outer surface and a core of floatation material located inwardly from the outer surface. The core of floatation material may occupy the entire chamber formed by the body or only a portion of the same, as long as a sufficient buoyant force is provided for the device as a whole. For example, the outer surface of the body may be formed of linear low density polyethylene (LLDPE). The core may be composed of a closed cell foam of LLDPE as well as a blowing agent. The body and core may be formed through a rotational molding procedure or method, known in the art.

In certain cases, a portion of the core may exist as a void. Access to the void may be obtained from the exterior of the body, through a removable plug, in order to add ballasting materials such as sand, metal, and the like to the float device. In this manner, the draft of the float of the present invention is adjustable.

The float device of the present invention is also formed with a spine that passes through the core of floatation material from one end of the body to the other. The spine also extends from the body outer surface and possesses a first end portion and an opposite second end portion. The spine may be formed of a non-corrosive material, such as square stock stainless steel.

Means is also included in the present invention for connecting a floatation body of the present invention to a like floatation body or float. Such interconnection means may include a flange, connected to at least the first end portion of the spine. In most cases, a flange would also be connected to the second end portion of the spine. Such flange may take the form of a tube which is inserted through the first or second end portions of the spine. A plate having an aperture therethrough encompasses the tube and interacts with an elongated member, also passing through the tube that is held in place by a fixation member such as a nut or other retainer. The elongated member may include an exterior threaded surface to interact with a threaded retainer, in this regard. In certain cases, at least one like plate may be employed with the tube or flange to hold the same relative to the spine and on an opposite end portion of the float from the position of the first plate. Such like plate or plates would also include apertures to engage flanges on a float device of similar construction and are held thereto with an elongated member and a retainer in the same manner as hereinbefore described. In addition, a fixation member may be held to the first or second end portions of the spine to engage a line leading to an anchor. Such anchor would be employed to moor the float device or a plurality of float devices when a boom is assembled. It should also be noted that the spine of the float device of the present invention is located below the center of gravity of the body to serve as a ballast to a certain degree.

It may be apparent that a novel and useful float device has been hereinabove described.

It is therefore an object of the present invention to provide a float device which is durable and may be used in fresh or saltwater environments to form a boom used to serve as a water barrier.

Another object of the present invention is to provide a float device which is formed by rotational molding procedures and includes a spine that serves as a portion of an interlinking mechanism as well as to partially ballast the float device.

Another object of the present invention is to provide a float device which may be formed of corrosion resistant materials.

A further object of the present invention is to provide a float device which may be interlinked to form a boom for use as a water barrier and which may be ballasted to varying degrees.

A further object of the present invention is to provide a float device which is relatively simple to manufacture and exhibits a sturdiness not found in prior art floats.

The invention possesses other objects and advantages especially as concerns particular characteristics and features thereof which will become apparent as the specification continues.

Figure 1:
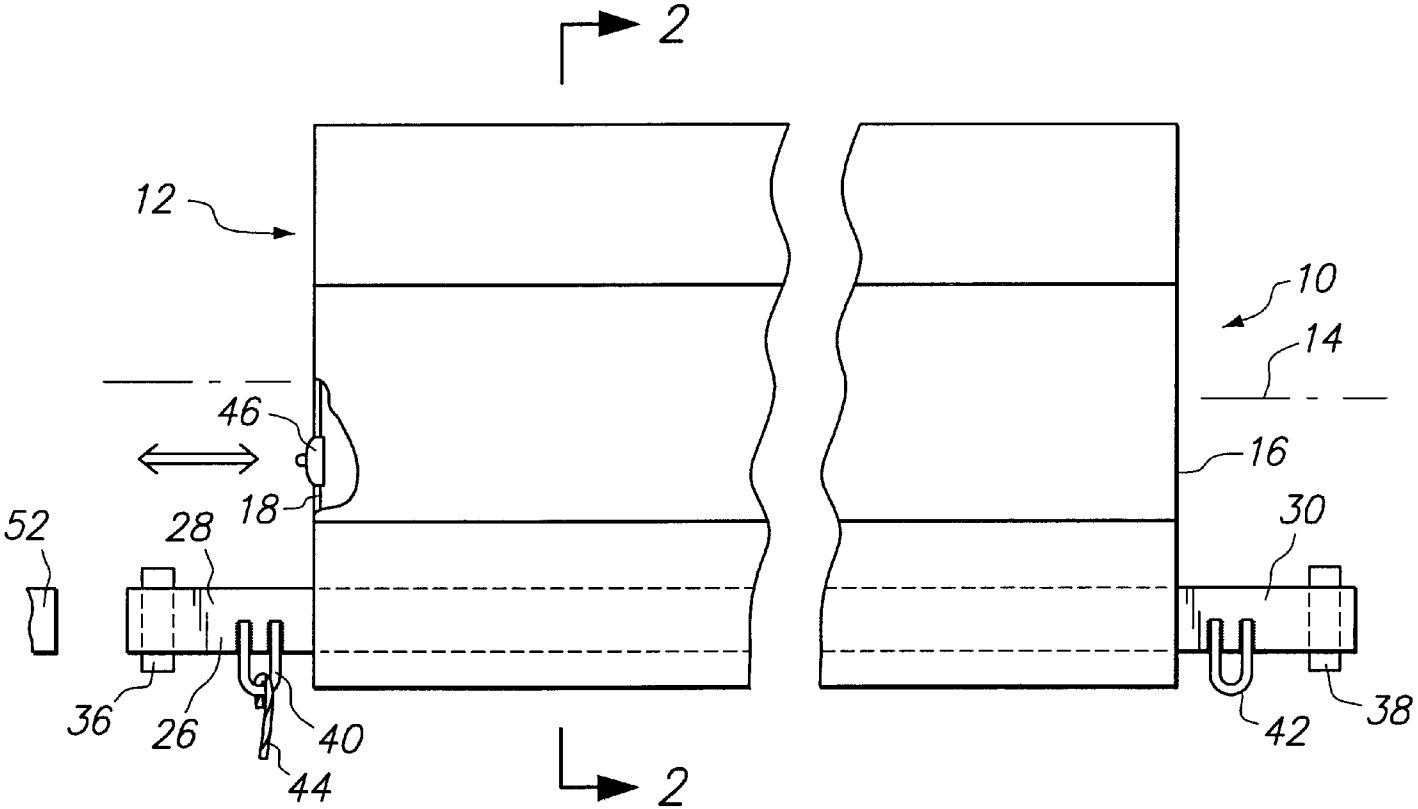
FIG. 1 is a broken side elevational view of the device of the present invention showing a broken away portion to illustrate a ballast adjustment feature.

For a better understanding of the invention reference is made to the following detailed description of the preferred embodiments thereof which should be taken in conjunction with the hereinabove described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior delineated drawings.

The invention as a whole is depicted in the drawings by reference character 10. Float device 10, FIG. 1, includes as one of its elements a body 12 which is generally extensive along an axis 14 and is octagonal in cross sectional configuration, best shown in FIG. 2. Referring again to FIG. 2, it may be apparent that body 12 includes an outer surface 16 formed by a shell 18. Shell 18 may be constructed of any suitable floatation-type material such as linear low density polyethylene (LLDPE). Shell 18 may be formed by rotational molding and include safety orange resin coloration for viewing of the same in a water environment such as on body of water 20.

Figure 2:
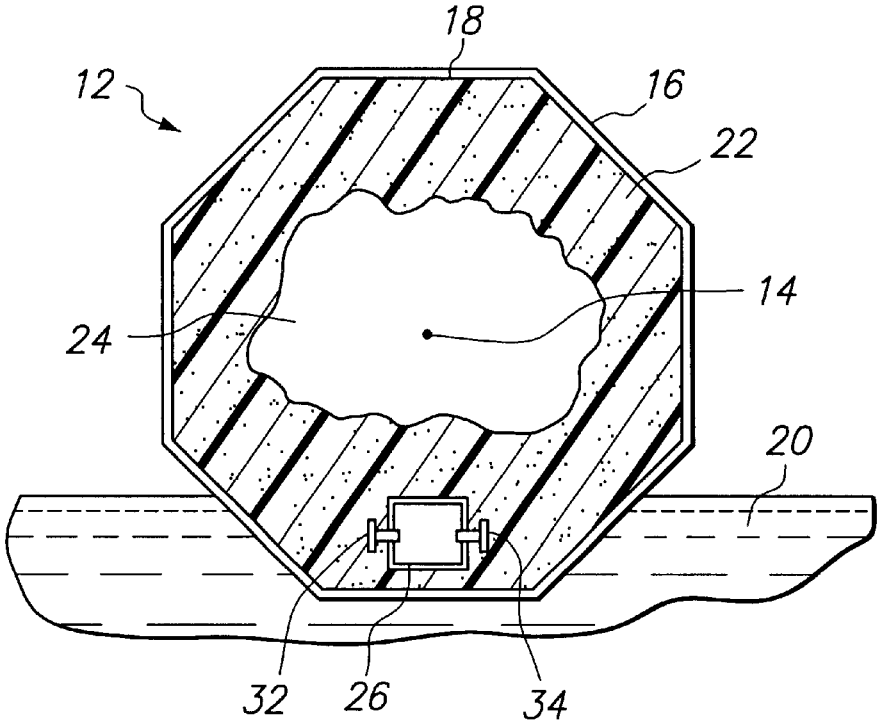
FIG. 2 is a sectional view taken along line 2—2 of FIG. 1.

Within shell 18 of body 12 lies a core 22 of floatation material. For example, core 22 may be formed of 90 percent LLDPE closed cell foam and 10 percent Cellogen OT blowing agent. As depicted in FIG. 2, a void 24 is left within core 22 since core 22 proper provides enough of a buoyant force to allow body 12 to float in body of water 12 as shown.

Again referring to FIGS. 1–3, device 10 is formed with a spine 26 which extends completely through core 22 of body 12. Spine 26 is generally constructed of corrosion resistant material such as stainless steel and is depicted in the embodiment shown in the drawings as existing in a square stock format. With reference to FIG. 1, it may be seen that spine 26 extends through body 12 and terminates in first end portion 28 and second end portion 30 which extends outwardly from outer surface 16 of body 12.

Turning to FIG. 2, it may be observed that protuberances 32 and 34 are depicted within core 22 as being attached to spine 26. Protuberances 32 and 34 aid in the fixation of spine 26 during the rotational molding process forming body 12 of floatation device 10.

Flanges 36 and 38 are also found in float device 10 and are fixed within first end portion 28 and second end portion 30, respectively, of spine 26. Flanges 36 and 38 may take the form of tubes which are fixed in bores or apertures that are drilled through first and second end portions 28 and 30. Flanges 36 and 38 are employed in the fixation or linking of float devices together to form a boom, which will be discussed hereinafter. In addition, U-shaped fixation members 40 and 42 are depicted as being welded to first and second end portions 28 and 30, respectively. A line 44 leads to an anchor (not shown) to aid in the holding of floatation device 10 in place on a body of water.

A plug 46 is removably held to shell 18 and permits the user of device 10 to fill void 14 with ballast material such as sand, metal, and the like. Such ballast would constitute an additional amount of ballast to that provided by spine 26 which lies below the center of gravity of float device 10, generally along axis 14. Plug 46 may be threaded, glued into place, or otherwise sealed to prevent water from entering void 14 of float body 12.

Figure 4:
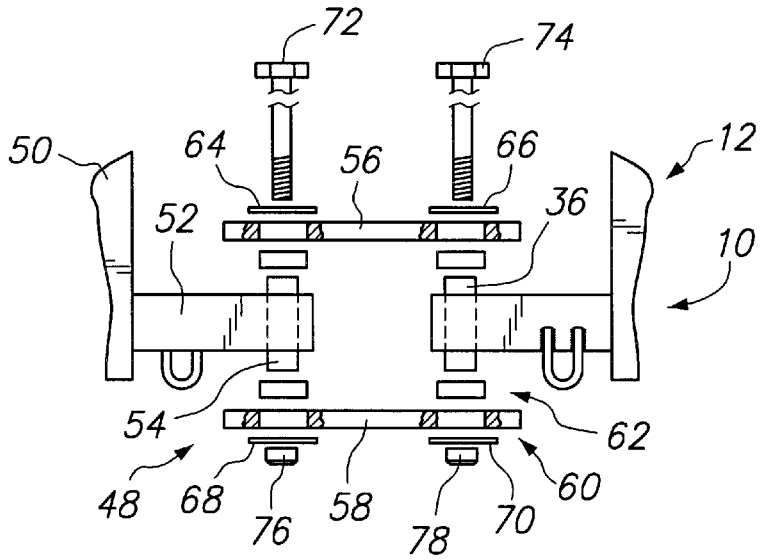
FIG. 4 is a side elevational exploded view of the interconnection system used between float devices of the present invention of like construction.

Turning to FIG. 4, it should be realized that means 48 is illustrated for connecting flange 36, and integral body 12 to a float 50 having a like construction to float device 10. In this regard, float 50 includes a spine end portion 52 and a flange 54. Means 48 includes plates 56 and 58 having a plurality of apertures 60 therethrough to accommodate flanges 36 and 54. A quartet of bushings 62 fit over the exposed ends of flanges 36 and 54 and lie within the plurality of aperture 60 of plates 56 and 58. Washers 64, 66 lie against plate 56, while washers 68 and 70 lie against plate 58. Elongated members such as threaded bolts 72 and 74, extend through the plurality of apertures and plates 56 and 58, as well as the openings through quartet of bushings 62. Threaded bolt 72 passes through washers 64 and 68 and is held in place by retainer nut 78. Likewise, threaded bolt 74 passes through washer 66 and 70 and is held in place by retainer nut 76. The above elements describe with respect to FIG. 4 are compressed by the tightening of retainers 76 and 78 from the exploded configuration shown in FIG. 4. Thus, means 48 holds float 50 to float device 10. Second end portion flange 38 of float device 10 may also be held using means 48 to a like float. Thus, a boom, such as boom 80 depicted in FIG. 5, may be formed as a floating water barrier.

Figure 5:
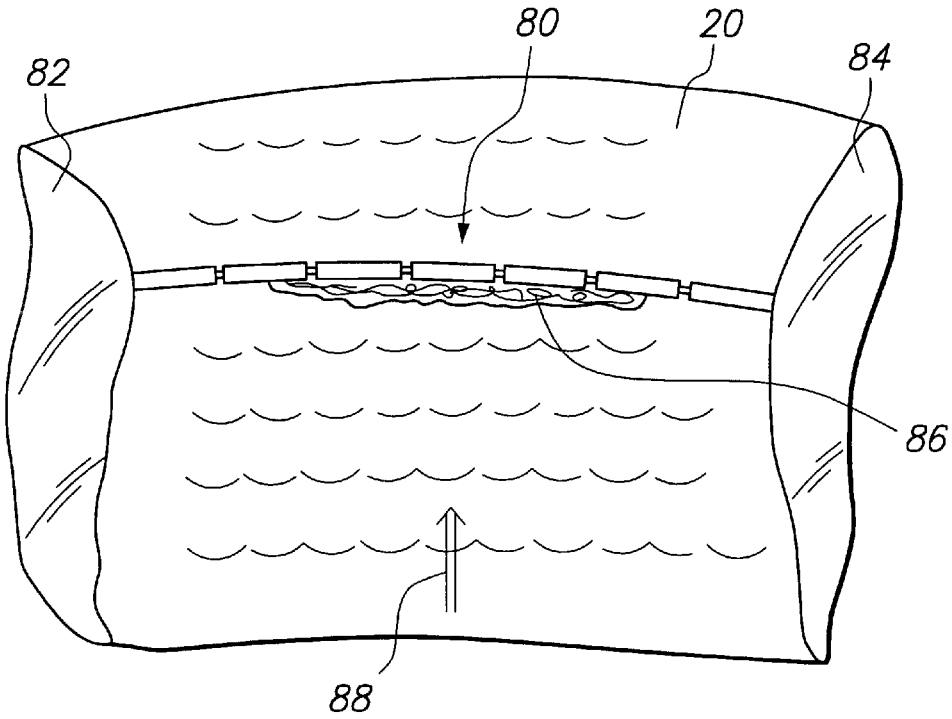
FIG. 5 is a top plan view of a boom system using the float devices of the present invention in place on a body of water to hold debris.

As viewed in FIG. 5, boom 80 extends between land bodies 82 and 84 that is held at land bodies 82 and 84 by suitable means. In addition, boom 80 is anchored by the use of fixation members, such as fixation members 40 and 42 with respect to device 10 depicted in FIG. 1. Boom 80 floats on water body 20 and is capable of holding floating debris mass 86 as shown. Generally, debris mass 86 gathers as a result of current or wind indicated by a force arrow 88 in FIG. 5.

Figure 3:
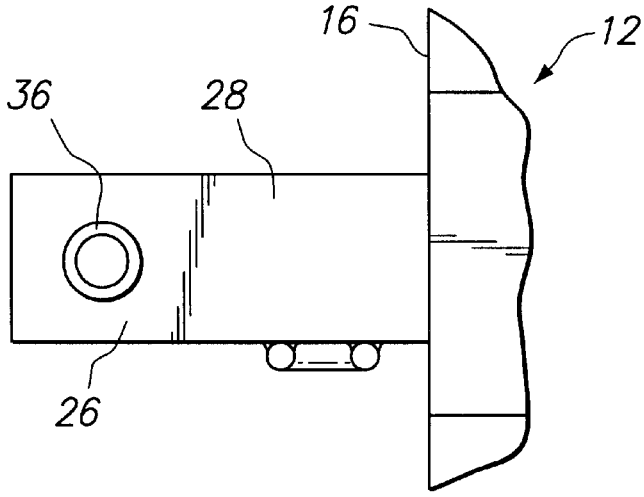
FIG. 3 is a top plan view of the first end portion of the spine member depicted in FIG. 1.

In operation, device 10 is constructed as shown in FIGS. 1–3 such that spine 26 extends outwardly from the outer surface 16 of body 12 as end portions 28 and 30. Flanges 36 and 38 are employed in conjunction with connecting means 48 depicted in detail in FIG. 4 to connect float device 10 to like float devices on either side. When a plurality of float devices 10 are assembled into a boom 80 the boom is strung across fixation point such as land bodies 82 and 84 to form a water barrier for boats and other items such as debris mass 86. The ballasting of each individual float unit, such as float unit 10 is achieved by the use of the location of spine 26 within core 22 of body 12 as well as the use of additional ballast through an opening removably covered by plug 26.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A float device, comprising:

a. a body having an outer surface and a core of floatation material located inwardly from said outer surface to provide buoyancy to said body, said core including a void and means for accessing said void from said outer surface of said body;

b. a spine passing through said core of floatation material, said spine including a first end portion and a second end portion, said first and second end portions extending outwardly from said outer surface of said body, said spine fixed to said core of floatation material; and c. means for linking said spine to another float device, said means for linking said spine to another float device comprising a first flange connected to at least said first end portion of said spine, and a second flange connected to said spine second end portion.

2. The device of claim 1 in which said means for linking said spine to another float device additionally comprises a fixation member connected to said spine first end portion and located adjacent said first flange.

3. The device of claim 1 in which said first flange comprises a tube.

4. A float device, comprising:

a. a body having an outer surface and a core of floatation material located inwardly from said outer surface to provide buoyancy to said body, said core including a void and means for accessing said void from said outer surface of said body;

b. a spine passing through said core of floatation material, said spine including a first end portion and a second end portion, said first and second end portions extending outwardly from said outer surface of said body, said spine fixed to said core of floatation material; and c. means for linking said spine to another float device, said means for linking said spine to another float device comprises a tube connected to at least said first end portion of said spine, and a plate having an aperture therethrough, and elongated member passing through said tube and said plate aperture, a retainer for holding said elongated member within said tube and said plate aperture, and means for fixing said plate to another float.

5. A float device, comprising:

a. a body having an outer surface and a core of floatation material located inwardly from said outer surface to provide buoyancy to said body, said core including a void and means for accessing said void from said outer surface of said body, said body extending along an axis of elongation;

b. a spine passing through said core of floatation material, said spine including a first end portion and a second end portion, said first and second end portions extending outwardly from said outer surface of said body, said spine fixed to said core of floatation material and extending through said body substantially parallel to said axis of elongation and below the center of gravity of said combined body and core of floatation material; and c. means for linking said spine to another float device.

6. The device of claim 5 in which said means for linking said spine to another float device comprises a flange connected to at least said first end portion of said spine.

7. The device of claim 6 in which said means for linking said spine to another float device includes said flange comprising a first flange, and which further includes a second flange connected to said spine second end portion.

8. The device of claim 6 in which said means for linking said spine to another float device additionally comprises a fixation member connected to said spine first end portion and located adjacent said flange.

9. The device of claim 8 in which said flange comprises a tube.

* * * * *